US009988830B2

(12) United States Patent
Raz

(10) Patent No.: US 9,988,830 B2
(45) Date of Patent: Jun. 5, 2018

(54) LATCH ARRANGEMENT HAVING A HANDLE

(71) Applicant: DAN RAZ LTD., Tirat Carmel (IL)

(72) Inventor: Amir Raz, Tirat Carmel (IL)

(73) Assignee: DAN RAZ LTD., Tirat Carmel (IL)

( * ) Notice: Subject to any disclaimer, the term of this patent is extended or adjusted under 35 U.S.C. 154(b) by 0 days. days.

(21) Appl. No.: 15/059,363

(22) Filed: Mar. 3, 2016

(65) Prior Publication Data

US 2017/0254125 A1 Sep. 7, 2017

(51) Int. Cl.

| | |
|---|---|
| ***E05B 65/06*** | (2006.01) |
| ***E05C 1/12*** | (2006.01) |
| ***E05B 15/00*** | (2006.01) |
| ***E05B 17/20*** | (2006.01) |
| ***E05B 65/08*** | (2006.01) |
| ***E05B 65/10*** | (2006.01) |

(52) U.S. Cl.

CPC ..... *E05C 1/12* (2013.01); *E05B 15/00* (2013.01); *E05B 17/2007* (2013.01); *E05B 65/06* (2013.01); *E05B 65/08* (2013.01); *E05B 65/1046* (2013.01)

(58) Field of Classification Search

CPC ..... E05C 1/12; E05B 65/1046; E05B 65/08; E05B 65/06; E05B 17/2007; E05B 15/00

USPC ..... 292/336.3, 347, 194, 195, 200, 341.15; 49/394, 367, 449, 368

See application file for complete search history.

(56) References Cited

U.S. PATENT DOCUMENTS

| | | | | |
|---|---|---|---|---|
| 313,742 | A | 3/1885 | Kintner | |
| 435,658 | A | 9/1890 | Brennaman | |
| 868,036 | A | 10/1907 | Tong | |
| 1,231,069 | A | 6/1917 | Scaffert | |
| 1,609,342 | A * | 12/1926 | Winters | E05B 65/005 292/173 |
| 1,973,461 | A | 9/1934 | Barringer | |
| 2,572,117 | A | 10/1951 | Gwersten | |
| 2,572,717 | A | 10/1951 | Gersten | |
| 2,579,875 | A | 12/1951 | Stanko | |
| 2,812,204 | A * | 11/1957 | Squire | E05C 1/145 292/169.14 |
| 2,834,066 | A | 5/1958 | Lybarger | |

(Continued)

FOREIGN PATENT DOCUMENTS

| | | |
|---|---|---|
| AU | 627346 | 2/1991 |
| AU | 641561 | 5/1992 |

(Continued)

*Primary Examiner* — Jerry E Redman

(74) *Attorney, Agent, or Firm* — Mark M. Friedman

(57) ABSTRACT

A latch arrangement for fastening a panel of a door or a window to a frame element is provided. The latch arrangement includes a locking element mounted on the frame element and displaceable between a locked position in which the locking element can be engaged with a depression formed on the panel locking thereby the panel to the frame element, and an unlocked position in which the locking element can be disengaged from the depression on the panel unlocking thereby the panel from the frame element; an actuating mechanism including a manually operable handle, the actuating mechanism being mounted on the panel and being configured to selectively engage the locking element and to displace the locking element away from the depression to the unlocked position.

20 Claims, 11 Drawing Sheets

(56) References Cited

U.S. PATENT DOCUMENTS 2,978,757 A * 4/1961 Ammerman ..... E05F 11/00 292/196
3,002,592 A 10/1961 Quinn
3,019,493 A 6/1962 Walenga
3,159,093 A 12/1964 Rosenfeld
3,172,168 A 3/1965 Suska
3,222,098 A * 12/1965 Hausfeld ..... E05B 65/0864 292/173
3,634,962 A 1/1972 Peterson
3,841,516 A 10/1974 Marz
3,872,696 A 3/1975 Geringer
3,877,282 A 4/1975 Williams
3,959,927 A * 6/1976 Good ..... E06B 7/16 49/366
4,004,629 A 1/1977 Kelly
4,045,065 A 8/1977 Johnson
4,062,576 A 12/1977 Jennings et al.
4,106,239 A 8/1978 Bancroft et al.
4,110,867 A 9/1978 Gwozdz
4,126,965 A 11/1978 Hoffmann
4,133,142 A 1/1979 Dzus, Jr.
4,178,859 A 12/1979 Seiz
4,180,287 A 12/1979 Youngblood et al.
4,203,255 A 5/1980 Naslund et al.
4,216,986 A 8/1980 McNinch et al.
4,230,351 A 10/1980 Bisbing
4,300,795 A 11/1981 Jennings
4,367,610 A 1/1983 Goode
4,428,153 A * 1/1984 Klinger ..... E05C 19/002 49/310
4,441,277 A 4/1984 Naylor
4,534,587 A * 8/1985 Fleming ..... B60J 7/1642 292/263
4,765,662 A 8/1988 Suska
4,831,779 A 5/1989 Kehrli et al.
4,856,830 A 8/1989 Chateau
5,137,327 A 8/1992 Edmonds
5,172,520 A * 12/1992 Hostetler ..... E05C 3/047 292/207
5,224,297 A 7/1993 Watkins
5,326,141 A * 7/1994 Gorman ..... E05B 63/20 292/173
5,349,782 A * 9/1994 Yulkowski ..... E05C 19/002 49/366
5,403,047 A * 4/1995 Walls ..... E05B 63/0069 292/173
5,409,272 A 4/1995 McCormack
5,465,460 A 11/1995 Cantone
5,660,021 A 8/1997 Wolgamont
5,901,501 A * 5/1999 Fountaine ..... E05C 3/14 292/228
5,927,773 A * 7/1999 Larsen ..... E05B 13/10 292/337
5,931,415 A 8/1999 Lingard et al.
6,185,871 B1 2/2001 Wang
6,286,274 B1 9/2001 McKann et al.
6,409,234 B1 * 6/2002 Larsen ..... E05C 1/145 292/173
6,564,428 B2 5/2003 Richard et al.
7,000,550 B1 2/2006 Mandall
7,182,374 B2 * 2/2007 Figge ..... B60R 5/04 292/173
7,576,531 B2 8/2009 LeOntaridis
7,707,776 B2 5/2010 Weissofner et al.
8,038,184 B2 10/2011 Grigis
8,146,393 B2 * 4/2012 Katagiri ..... E05B 17/18 292/336.3
8,424,931 B2 * 4/2013 Chang ..... G11B 33/123 292/137
8,627,606 B2 1/2014 Salerno
8,813,427 B2 8/2014 Meeks
9,670,691 B2 * 6/2017 Mansueto ..... E05B 1/00
2002/0046501 A1 4/2002 Webb
2002/0095885 A1 7/2002 Sampson
2002/0163208 A1 11/2002 Quigley
2004/0222649 A1 * 11/2004 Ito ..... E05B 1/0053 292/336.3
2005/0001436 A1 1/2005 Ramsauer
2006/0021400 A1 2/2006 Jackson
2007/0290456 A1 12/2007 Speyer
2008/0129054 A1 * 6/2008 Tremble ..... E05B 15/102 292/33
2009/0289065 A1 11/2009 Sampson
2013/0000205 A1 1/2013 Raz et al.
2014/0259946 A1 * 9/2014 Mansueto ..... E05B 1/003 49/449
2015/0123411 A1 * 5/2015 Woo ..... E05B 1/0007 292/336.3
2016/0001643 A1 * 1/2016 Ichikawa ..... E05B 79/20 49/352
2016/0032627 A1 * 2/2016 Yoshino ..... E05B 85/16 292/336.3
2016/0076275 A1 * 3/2016 Uemura ..... E05B 85/13 292/141
2016/0076280 A1 * 3/2016 Rudraraju ..... E05B 77/06 292/336.3
2016/0083976 A1 * 3/2016 Rickenbaugh ..... E05B 7/00 292/336.3

FOREIGN PATENT DOCUMENTS

CA 1029063 4/1978
DE 929592 5/1955
DE 8900012 3/1969
DE 2628036 1/1977
DE 3447796 7/1986
DE 29517077 2/1997
DE 10117173 10/2002
DE 10322798 12/2004
DE 102004064981 8/2007
DE 10329560 6/2012
EP 0067065 12/1985
EP 1422368 5/2004
EP 1574557 9/2005
FR 2631068 11/1989
FR 2891295 3/2007
GB 1399058 6/1975
GB 1399058 A 6/1975
GB 2154639 B 6/1987
GB 2195958 A 4/1988
GB 2233701 1/1991
GB 2233701 A 1/1991
GB 2250772 6/1992
GB 2250772 A 6/1992
GB 2521932 A 7/2015
WO 2013001488 A1 1/2013
WO WO 2013018496 A1 * 2/2013 ..... E05D 1/04

* cited by examiner

LATCH ARRANGEMENT HAVING A HANDLE

FIELD OF INVENTION

The presently disclosed subject matter relates to a latch arrangement having handle, in general and in particular for a latch arrangement for fastening a panel of a door or a window to a frame element.

BACKGROUND

A latch arrangement for fastening a panel of a door or a window to a frame element is an arrangement which includes a locking element displaceable with respect to the panel between a locked position in which the locking element is engaged with the frame element and the panel precluding thereby the displacement of the panel away from the frame element. The locking element can be mounted on the frame element and displaceable towards and away from the panel so as to lock the panel to the frame element. Alternatively, the locking element can be mounted on the panel and can be displaceable towards and away from the frame element so as to lock the panel to the frame element.

U.S. Pat. No. 4,803,808 discloses a swivel fitting for an outwardly opening window, with a device for moving the casement frame between the closed position and the open position, for example in the form of a hand crank, with position-fixing arm driven by the crank and with an operating handle on one frame member of the stationary frame, in order to fix the casement frame in the closed position. At least one locking plate is included on the casement frame which co-operates with a locking element on a drive rod operable by the handle. When the window is in the closed position, a locking projection of the locking plate protrudes into a groove in the stationary frame so that the closing movement of the window may be supported relatively early by actuation of the handle and to ensure high security against break-in.

SUMMARY OF INVENTION

There is provided in accordance with an aspect of the presently disclosed subject matter a latch arrangement for fastening a panel of a door or a window to a frame element, the panel including a depression. The latch arrangement includes a locking element mounted on the frame element and displaceable between a locked position in which the locking element can be engaged with the depression on the panel locking thereby the panel to the frame element, and an unlocked position in which the locking element can be disengaged from the depression on the panel unlocking thereby the panel from the frame element; an actuating mechanism including a manually operable handle, the actuating mechanism being mounted on the panel and being configured to selectively engage the locking element and to displace the locking element away from the depression to the unlocked position.

The handle can be pivotally mounted on the panel and can be displaceable between a first position in which the locking element can be urged away from the depression and a second position in which the locking element can be free to engage the depression. In the first position the handle can be pivoted towards an opening direction of the panel.

The actuating mechanism includes an actuating member slidably mounted on the panel and configured to selectively slide towards the locking element whereby the locking element can be displaced to the unlocked position. The handle includes a portion engaging the actuating member, and wherein the handle can be configured such that when the handle can be pivoted the actuating member can be pushed towards the locking element whereby the locking element can be displaced to the unlocked position.

The handle includes a panic bar configured to pivot towards the panel and a sloped member configured to pivot with the panic bar, the sloped member being configured to engages the actuating member, and wherein when the panic bar can be pivoted towards the panel the sloped member can be configured urge the actuating member to slide towards the locking element. The actuating member can be configured to slide in a groove extending transversely to the panel.

The latch arrangement can further include a stop latch mounted on the locking element and being configured to selectively displace between a secured position in which the locking element can be secured in the locked position, and a released position in which the locking element can be free to displace to the unlocked position, wherein the actuating mechanism can be configured to selectively displace the stop latch to the released position.

The actuating mechanism can be configured such that motion of the handle performs sequentially release of the stop latch following by a displacement of the locking element out of engagement. The stop latch can be mounted on said locking element and can be configured to selectively engage an abutment feature such that displacement of said locking element to the unlocked position is precluded. The stop latch can be slidably mounted on said locking element and is configured to slide between a secured position in which at least one portion thereof is engaged with said abutment feature and a released position in which said at least one portion is retracted away from said abutment feature such that the locking element is free to be displaced to the unlocked position. The abutment feature can be defined on the panel.

The stop latch can be pivotally mounted on the locking element and can be configured to pivot between a secured position in which the locking element can be secured in the locked position and a released position in which said locking element can be free to be displaced to said unlocked position, and wherein said actuating mechanism can be configured to selectively pivot said stop latch to said released position. The abutment feature can be defined on the frame element.

The actuating mechanism can include a catch member and wherein in the secured position the stop latch can be engaged with the catch member.

The locking element can be pivotally mounted on the frame element, and wherein the actuating mechanism can be configured to selectively pivot the locking element away from the depression to the unlocked position. The locking element in the locked position can be extended at an oblique angle with respect to the panel such that a first end of the locking element can be configured to engage the depression and while a second end of the locking element can be engaged with a portion of the frame element, and wherein in the locked position displacement of the panel towards an opening direction of the panel can be opposed by compressive forces exerted on the locking element and on the portion of the frame element.

There is provided in accordance with another aspect of the presently disclosed subject matter a door or a window including a frame element; a panel configured to abut against a portion of the frame element, the panel including a depression; a locking element mounted on the frame element and displaceable between a locked position in which the locking element can be engaged with the depression on the panel locking thereby the panel to the frame element, and an unlocked position in which the locking element can be disengaged from the depression on the panel unlocking thereby the panel from the frame element; and an actuating mechanism mounted on the a frame element and including a manually operable handle, the actuating mechanism being configured to selectively engage the locking element and to displace the locking element away from the depression to the unlocked position.

The panel can be a sliding panel configured to slide towards and away from the frame element, between a closed state and an open state.

The panel can be a hinged panel configured to rotate towards and away from the frame element, between a closed state and an open state.

The terms "shift" and "displace" as used herein the specification and claims refers generically to any mechanical displacement of various elements including but not limited to linear displacement, pivot movement, rotational movement etc. The term "panel" is used to refer to the element deployed across at least part of the opening in the closed state. The panels and corresponding closures may be doors, windows or any other type of opening which is selectively closed (or partially closed) by a hinged or a sliding panel.

The phrase "mounted on" as used herein refers to a first element affixed to a second element in any disposition between the two elements including the first element disposed on the second element, inside the second element, affixed to any outer surface of the second element, etc.

The phrase "defined on" as used herein refers to a feature or an element provided on a member in any manner, including integrally formed with the member, attached to the member etc.

The term "door" as used herein the specification and claims refers generically to any moving panel configured to selectively block off and allow access through an opening to a structure, such as a building or vehicle, an entrance to a confined area, or between two confined areas including hinged door, sliding door, a window of any type, as well as a hood and a trunk for covering vehicles or portions thereof, etc.

BRIEF DESCRIPTION OF THE DRAWINGS

In order to understand the disclosure and to see how it may be carried out in practice, embodiments will now be described, by way of non-limiting examples only, with reference to the accompanying drawings, in which:

FIG. 1E is a front view of the panel of FIGS. 1A-1D within a frame;

FIG. 2F is a front view of the panel of FIGS. 2A-2E within a frame;

FIG. 3A is a perspective view of a panel having latch arrangement in accordance with another example of the presently disclosed subject matter cut-away along line X-X of FIG. 3F;

FIG. 3B is a partial cross-sectional view taken along the line X-X of FIG. 3F showing the panel of FIG. 3A;

FIG. 3F is a front view of the panel of FIGS. 3A-3E within a frame;

FIG. 5F is a front view of the panel of FIGS. 5A-5E within a frame;

FIG. 6C is a view similar to FIG. 6B showing the panel in an unlocked position of the latch arrangement.

Figure 1A:
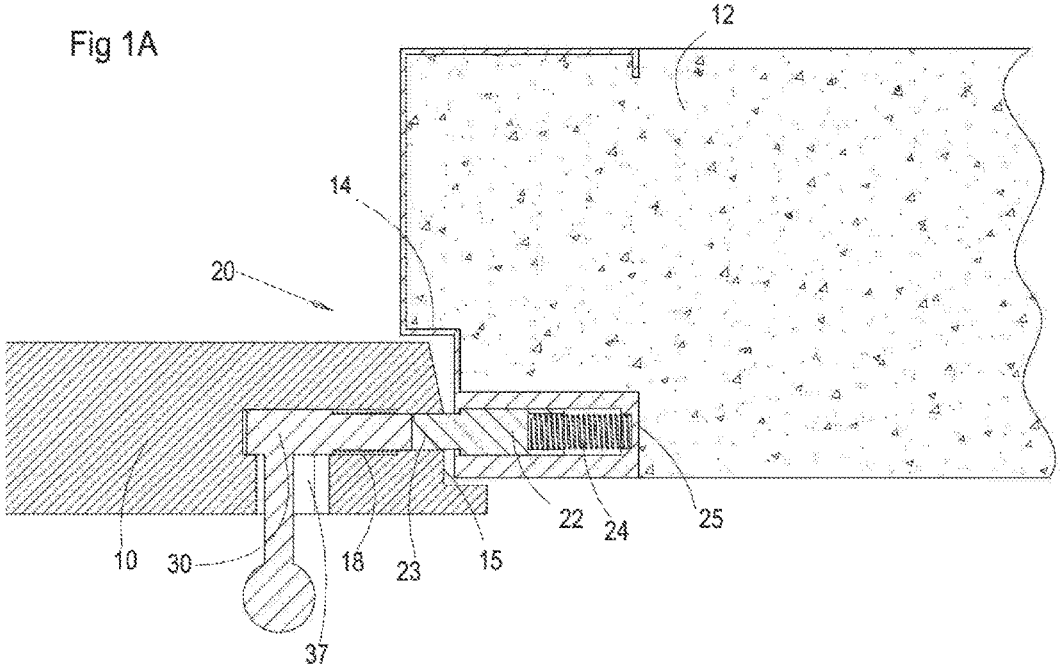
FIG. 1A is a partial cross-sectional view taken along the line X-X of FIG. 1E of a panel having latch arrangement in accordance with an example of the presently disclosed subject matter.

All of the sectional views herein, unless otherwise stated, are horizontal cross-sectional views taken in a horizontal plane passing through a handle on the panel.

DETAILED DESCRIPTION OF EMBODIMENTS

The invention relates to a latch arrangement for fastening a panel, such as a door or a window, to a frame element around an opening. The latch arrangements includes a locking element such as a bolt or latch, displaceably mounted relative to the frame element for selectively engaging a corresponding depression in the panel of the door or the window. The present invention provides a manually operable handle mounted on the door or the window panel which interacts, by means of an actuating mechanism, with the locking element on the frame element. The actuating mechanism is configured to selectively displace the locking element out of engagement with the depression defined on the door or the window panel.

Thus opening the panel of the door or the window can be carried out by the handle on the door without having to interact with a mechanism on the frame. As explained in detail with reference to the figures, the handle can have various shapes and can be configured in different manners, for example direction of operation, and methods of interactions with the actuating mechanism.

A first implementation of the invention in the context of a sliding bolt will be presented herein with reference to FIGS. 1A-1D, and illustrates the underlying principles of an aspect of the invention. Various particularly preferred implementations illustrated in the remaining drawings employ locking configurations in which a locking element is pivotally mounted relative to a frame element. Locking configurations of this type have been found to provide highly advantageous mechanical properties, particularly where any applied load applied to try to force open the panel is distributed along a locking element which extends along a significant length of the frame element (typically more than 10%, and in some cases along a majority, of the length of the frame element). An aspect of the present invention provides a solution for opening of such frame-mounted locking mechanisms via a manually-operated handle mounted on the panel, thereby combining the mechanical advantages of the frame-mounted locking configuration with the intuitive operation of a panel-mounted handle.

Further, according to an example, if the locking element is provided with a deadlock feature, the actuating mechanism is preferably configured such that motion of the handle performs sequentially release of the deadlock and then displacement of the locking element out of engagement.

FIGS. 1A to 1D show a hinged door including a door panel 10, a frame element 12, and a latch arrangement 20 for fastening the panel 10 to the frame element 12. Although the description here is directed by way of a non-limiting example to a door, it will be appreciated that the latch arrangement can be equally implemented in the context of a window or any other situation where a displaceable panel is selectively locked in place across an opening.

As shown in FIGS. 1A to 1D, the door panel 10 is configured to abut, in the closed state thereof, against a shoulder portion 14 defined on an abutting portion 13 of the frame element 12. The abutting portion 13 is so disposed with respect to the door panel 10 such that it faces a frame facing portion 15 of the door panel 10, when the latter is in the closed state.

Figure 1B:
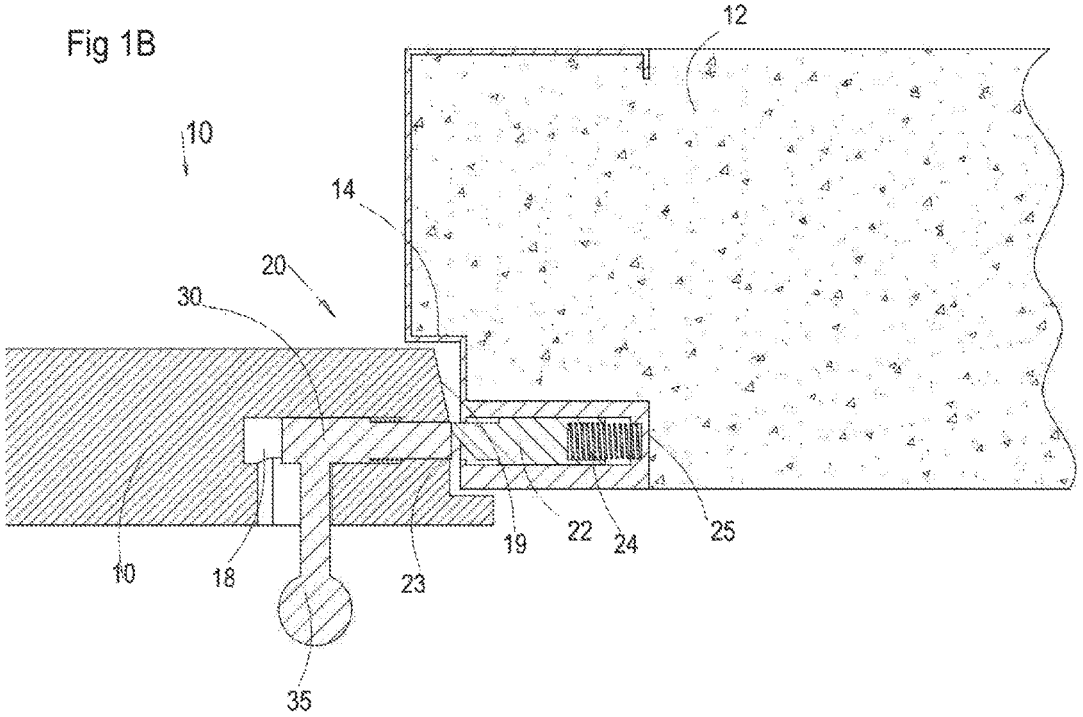
FIG. 1B is a view similar to FIG. 1A showing the panel in an unlocked position of the latch arrangement.

The latch arrangement 20 includes a locking element, here illustrated as a retractable pin 22 slidably mounted inside a frame groove 24, which is defined on the abutting portion 13 of the frame element 12. The retractable pin 22 is configured such that a portion thereof slides in and out of the frame groove 24, between a locked position, as shown in FIG. 1A, and an unlocked position, as shown in FIG. 1B and as explained hereinafter. According to an example, the retractable pin 22 can include a sloped tip 23 which is configured to extend out of the frame groove 24 in the locked position. The retractable pin 22, can be biased by a spring 25 mounted inside the frame groove 24 such that the retractable pin 22 is normally urged to the locked position, i.e. at least a portion of the retractable pin 22 projects outwards from the frame groove 24.

The door panel 10 includes a panel groove 18 defined on the frame facing portion 15 of the door panel 10. The panel 10 is configured such that when in the closed state thereof, the panel groove 18 is coaxially disposed with respect to the frame groove 24. This way, in the closed state of the door panel 10, the retractable pin 22 extends outwardly from the frame groove 24 and into the panel groove 18, locking thereby the panel 10 to the frame element 12, as shown in FIG. 1A.

The retractable pin 22 is thus displaceable between a locked position and an unlocked position. In the locked position, the retractable pin 22 extends out of the frame groove 24 such that when the panel 10 is in the closed state thereof, at least a portion of the retractable pin 22, i.e., the sloped tip 23, is engaged with the panel groove 18 on the panel 10, locking thereby the panel to the frame element 12. In the unlocked position, on the other hand, the retractable pin 22 is disengaged from the panel groove 18 unlocking thereby the panel 10 from the frame element 12, as shown in FIG. 1B. In the unlocked position, the retractable pin 22 can be fully or partially disposed inside the frame groove 24, such that the panel 10 can be pivoted to the open state of the door or the window.

It is appreciated that although, in the present example the retractable pin 22 is configured to engage in the locked position the panel groove 18, according to other examples the panel groove 18 can be replaced with a depression configured to allow firm engagement with the retractable pin 22.

Figure 1C:
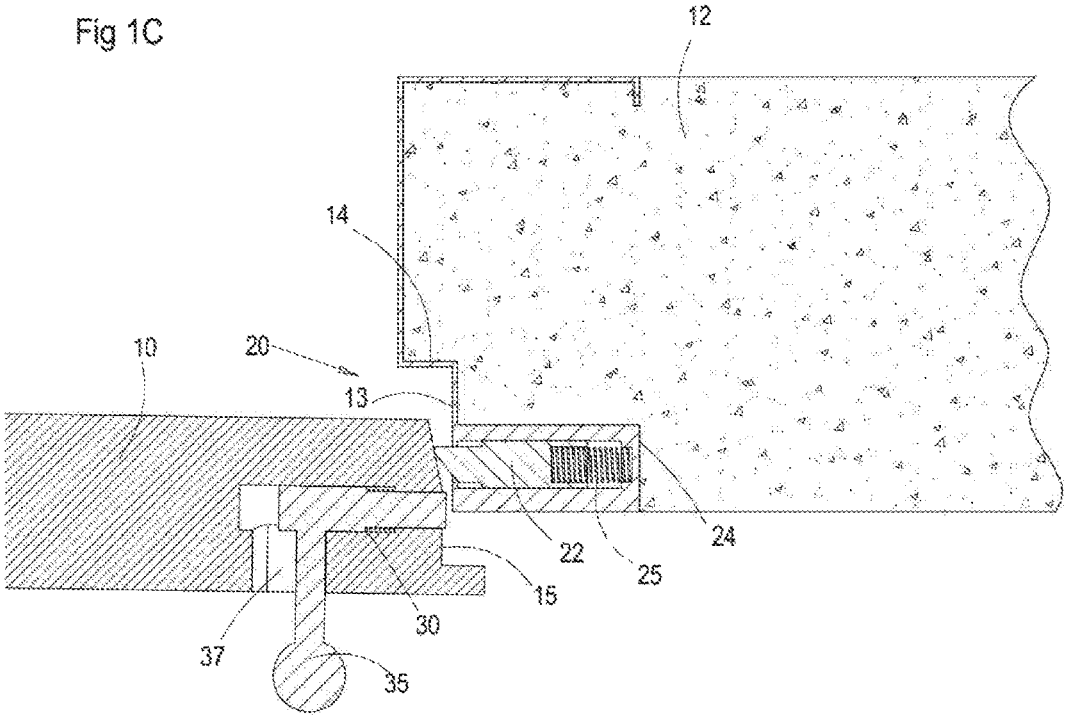
FIG. 1C is a view similar to FIG. 1A showing the panel in an opened state thereof and in which the latch arrangement is in an unlocked position.
Figure 1D:
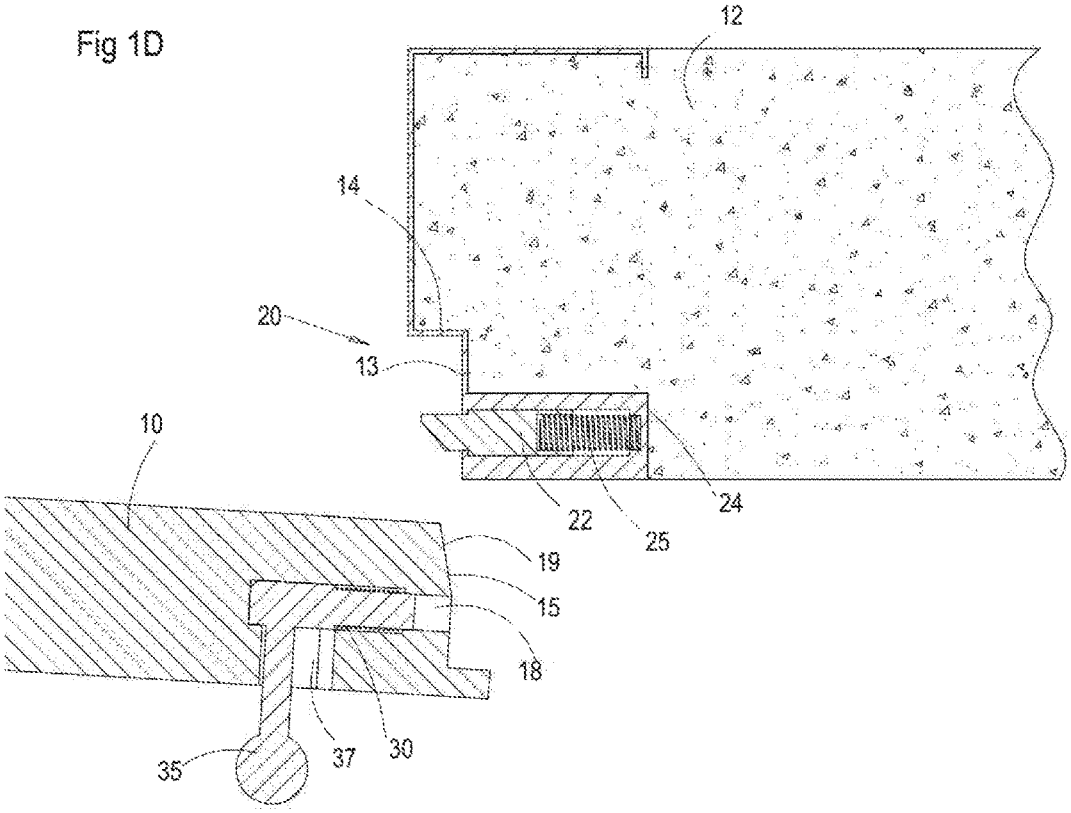
FIG. 1D is a view similar to FIG. 1A showing the panel in an opened state thereof and in which the latch arrangement is in a locked position.

The latch arrangement 20 further includes an actuating mechanism, having an actuating member, here illustrated as an actuating pin 30 slidably disposed inside the panel groove 18. The actuating pin 30, according to an example, has a length slightly smaller than the length of the panel groove 18 such that actuating pin 30 can slide inside the panel groove 18 while the end of the panel groove 18 close to the frame facing portion 15 of the door panel 10 is unoccupied. This way, the actuating pin 30 can slide between a retracted position, as shown in FIGS. 1A and 1D, in which the actuating pin 30 is disposed on the inner end of the panel groove 18, and a forward position, as shown in FIGS. 1B and 1C, in which actuating pin 30 is disposed on the outer end of the panel groove 18, such that the end of the actuating pin 30 is substantially flush with the frame facing portion 15 of the door panel 10.

Accordingly, when the door panel 10 is in the closed state thereof, as shown in FIG. 1A, the actuating pin 30 can be slid to the retracted position, allowing the retractable pin 22 to engage the panel groove 18, and the sloped tip 23 to be inserted inside the unoccupied end of the panel groove 18, fastening thereby the door panel 10 to the frame element 12. The actuating pin 30 can however, be slid to the forwards position pushing thereby the retracted pin 22 out of the panel groove 18 to the unlocked position thereof, such that the sloped tip 23 is disengaged from the panel groove 18 and the door panel 10 is free to be displaced away from the frame element 12 and to the opened state of the door panel 10, as shown in FIG. 1B.

According to the present example a manually operable handle 35 is coupled to the actuating pin 30, and protrudes from the surface of the panel 10, allowing thereby a user to interact therewith. The handle 35 can extended through an opening 37 defined between the panel groove 18 and an outer surface of the panel 10. The opening 37 can be configured to allow sideward displacement of the handle 35. For example, the opening 37 can be wider than the width of the handle 35 such that the latter is free to be displaced in an axis parallel to the axis of the panel groove 18.

Accordingly, when the door panel 10 is in the closed state thereof the handle 35 can be moved towards the frame element 12, displacing thereby the actuating pin 30 inside the panel groove 18 to the forward position thereof. As a result the retracted pin 22 is pushed out of the panel groove 18 to the unlocked position thereof; pushing thereby the sloped tip 23 of the retractable pin 22 to disengage from the panel groove 18 such that the door panel 10 is free to be displaced away from the frame element 12 and to the opened state of the door panel 10, as shown in FIG. 1B.

The frame facing portion 15 of the panel 10 can include a sloped portion 19 configured to interact with the sloped tip 23 of the retractable pin 22. That is to say, the sloping direction of the sloped portion 19 corresponds the sloping direction of the sloped tip 23, such that when the panel is pivoted from the opened state thereof to the closed states thereof the sloped portion 19 of the frame facing portion 15 engages the sloped tip 23. This way, when the panel is pivoted towards the shoulder portion 14 the displacement thereof is not blocked by the retractable pin 22 even when the latter is in the locked position thereof, i.e. the sloped tip 23 protrudes out of the frame groove 24. Rather, the sloped portion 19 engages the sloped tip 23 of the retractable pin 22 and gradually displaces the retractable pin 22 to the retracted position thereof, such that the frame facing portion 15 can abut the shoulder portion 14.

It is appreciated that the retractable pin 22 according to other examples, can be replaced with ball bearing configured to selectively engage the panel groove 18. The ball bearing can be configured to be retracted when it is engaged by the frame facing portion 15, for example, when the panel 10 is displaced to the closed state thereof. This way, the frame facing portion 15 can be formed without the sloped portion 19.

In addition, it will be appreciated by those skilled in the art that although the present example is a hinged door panel, a similar latch arrangement can be used for a sliding door.

FIG. 2A to 2E illustrates another example of a door or a window having latch arrangement 51 configured for fastening a panel 50 to a frame element 52. According to the present example the panel 50 is a panel of a hinged door and is configured to abut, in the closed state thereof, against a shoulder portion 54 defined on the frame element 52. The frame element 52 further defines a housing 55 for holding therein the latch arrangement 51, such that the frame facing portion 57 of the door panel 50 can be engaged by the latch arrangement 51, when the door is in the closed state thereof.

Figure 2A:
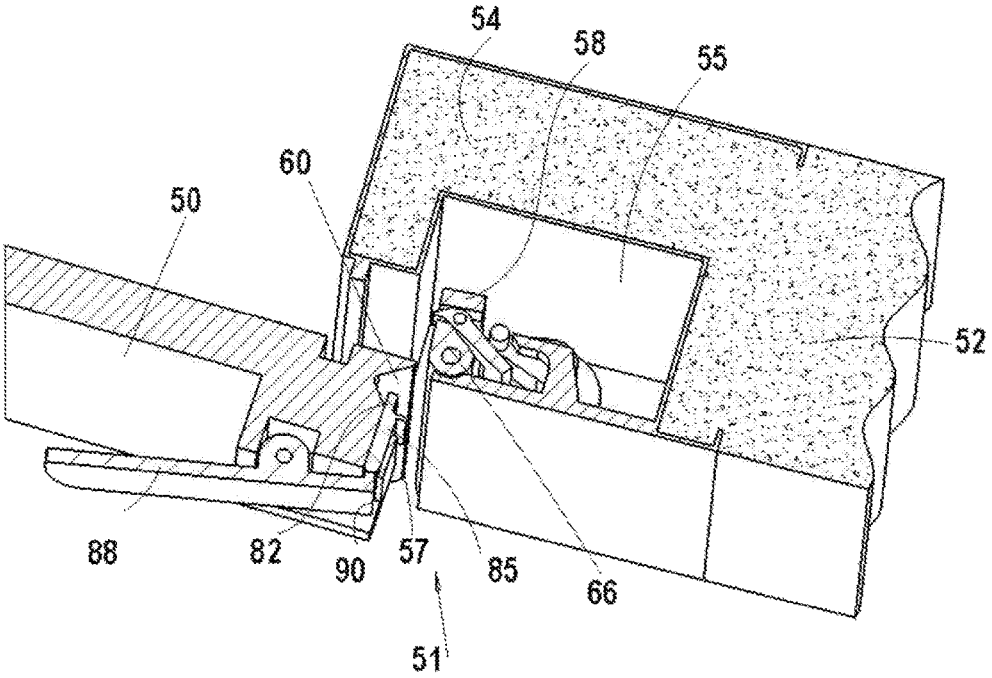
FIG. 2A is a perspective view of a panel having latch arrangement in accordance with another example of the presently disclosed subject matter cut-away along line X-X of FIG. 2F.
Figure 2B:
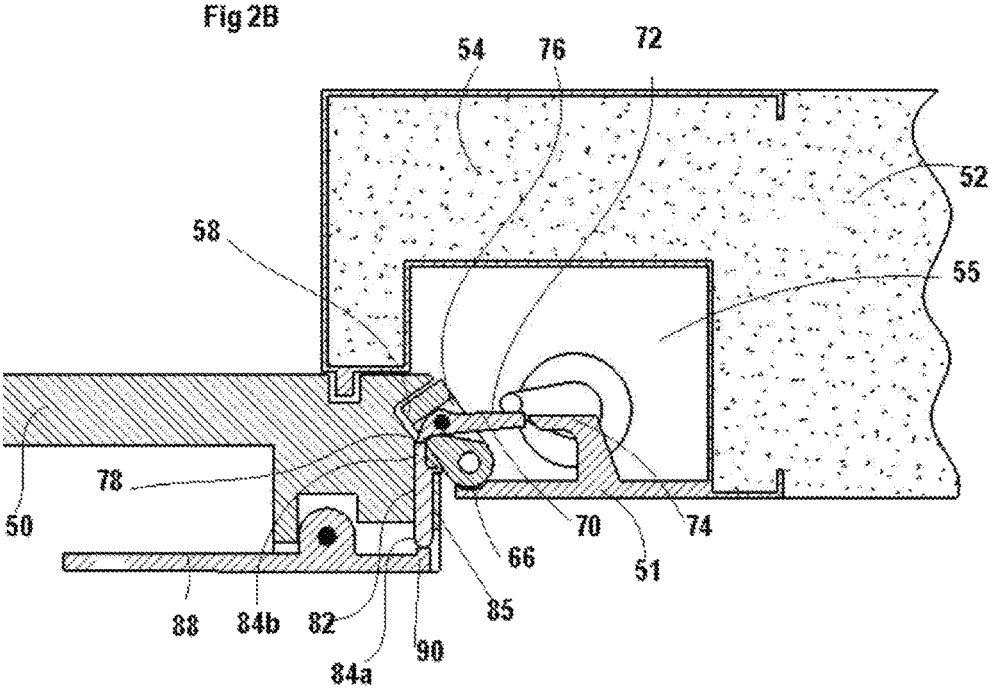
FIG. 2B is a partial cross-sectional view taken along the line X-X of FIG. 2F showing the panel of FIG. 2A.
Figure 2C:
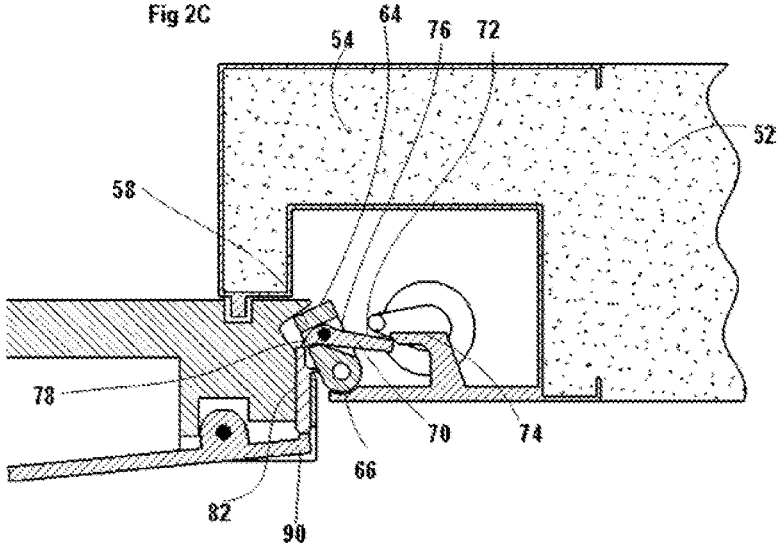
FIG. 2C is a view similar to FIG. 2B showing the panel in a locked position of the latch arrangement.
Figure 2D:
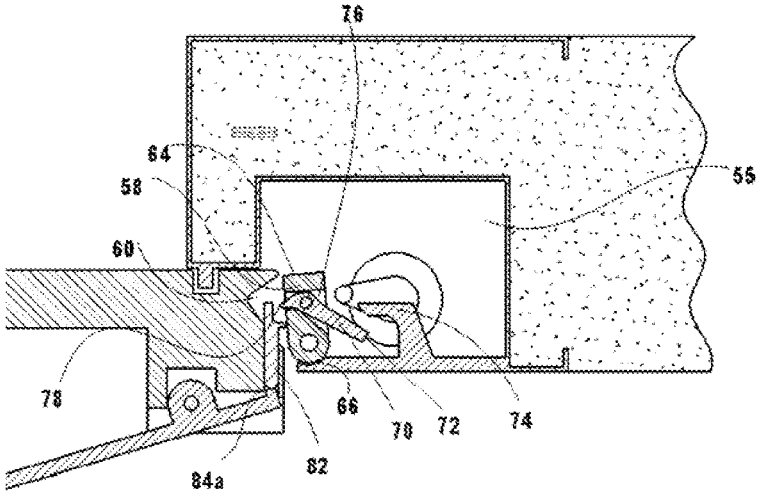
FIG. 2D is a view similar to FIG. 2B showing the panel in an unlocked position of the latch arrangement.
Figure 2E:
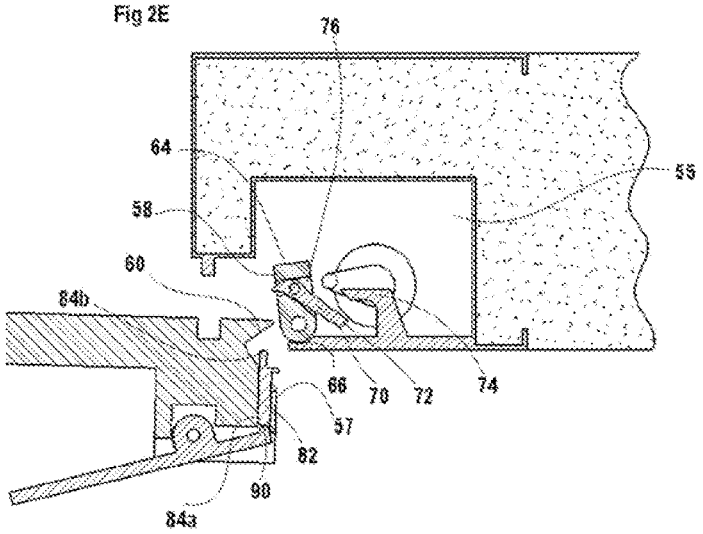
FIG. 2E is a view similar to FIG. 2B showing the panel in an opened state thereof and in which the latch arrangement is in an unlocked position.
Figure 2C:
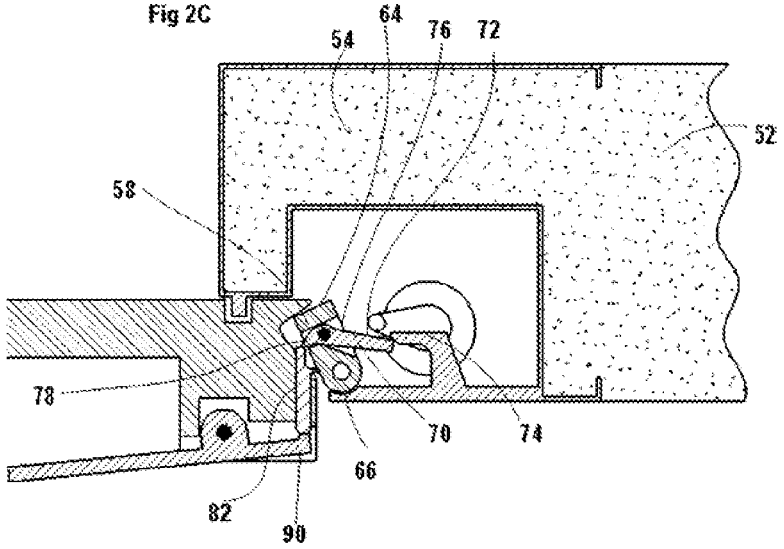
Figure 2D:
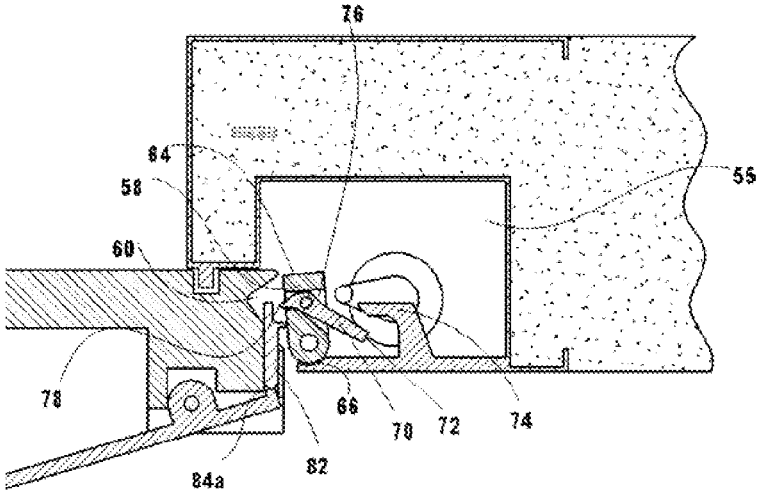
Figure 2E:
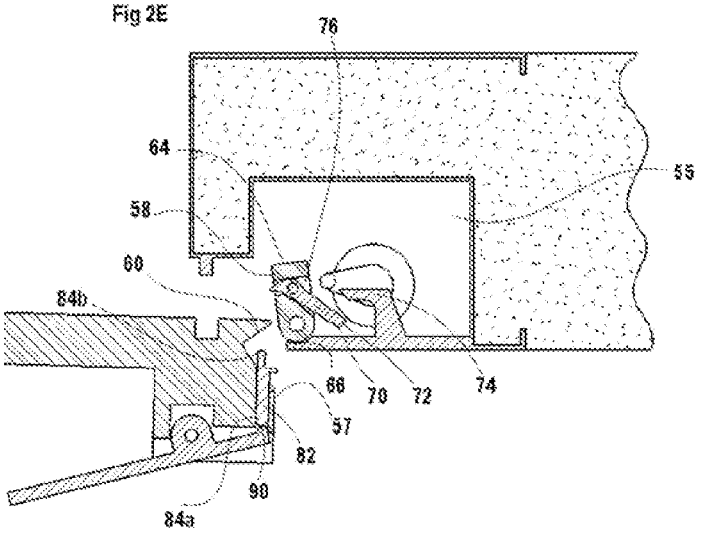

The latch arrangement 51, according to the present example, includes a locking element 58 pivotally mounted on the frame element 52 and displaceable between a locked position, as shown in FIGS. 2B and 2C, and an unlocked position shown in FIGS. 2A, 2D and 2E.

The locking element 58, can include a first end 64 configured to engage a depression 60 defined on the frame facing portion 57 of the door panel 50, and a second end 66 affixed to the frame element 52. In order to allow pivot of the locking element 58 about the second end 66, the latter has a rounded shape, and is mounted on a corresponding seat defined on the frame element 52.

According to an example, as shown in FIG. 2B, in the locked position, the locking element 58 is pivoted towards the panel 50 and away from the housing 55 and is disposed at an oblique angle with respect to the panel 50. The depression 60 on the frame facing portion 57, according to this example, is defined as a sloped cutaway which presents an angled surface with respect to the frame facing portion 57. The angle of the sloped cutaway depression 60 corresponds to the angle of the locking element 58 with respect to the panel 50, when the locking element 58 is in the locked position. This way, when the door panel 50 is in the closed state thereof and the locking element is pivoted to the locked position, the first end 64 of the locking element 58 is engaged with the cutaway depression 60, locking thereby the panel 50 to the frame element 52. It should be noted that the term "cutaway" is used herein as descriptive of the final form of depression 60, without in any way limiting the manufacturing technique used to produce the configuration, which does not necessarily include "cutting".

When the locking element 58 is pivoted away from the cutaway depression 60, the first end 64 of the locking element 58 is disengaged from the cutaway depression 60 on the panel 50, such that the latter is unlocked and can freely rotate to the opened state thereof, as shown in FIGS. 2D and 2E.

It is appreciated that the locking element 58 can extend along the entire or the majority of the length of the frame element, such that in the locked position it is engaged with the cutaway depression 60 which can also be defined along the entire or the majority of the length of the frame facing portion 57.

The latch arrangement 51 according to the present example further includes deadlock element, here illustrated as a stop latch 70 selectively deployable to secure the locking element 58 in the locked position.

The stop latch 70 is pivotally mounted on the locking element 58 and is configured to secure the locking element 58 in the locked position. For example, the stop latch 70 can include a tail portion 72 extending into the housing 55 and configured to selectively engage an abutment feature 74 defined on the frame element 52. The stop latch 70 further includes a head tip 78 defined on an end of the stop latch 70, opposing the tail portion 72 and extending towards the frame facing portion 57.

The stop latch 70 is configured to pivot between a secured position, in which the locking element 58 is secured in the locked position thereof, and a released position in which the locking element 58 is free to pivot towards the housing 55 disengaging thereby the cutaway depression 60 of the panel 50.

In the secured position, shown in FIG. 2B, the tail portion 72 is engaged with the abutment feature 74 such that pivoting of the locking element 58 towards the housing is precluded, and the latter is maintained in the locked position thereof. In the released position, on the other hand, the stop latch 70 is slightly pivoted such that the tail portion 72 is disengaged from the abutment feature 74 such that the displacement of the locking element 58 away from the depression 60 to the unlocked position is no longer precluded.

According to an example, the stop latch 70 is mounted in a channel 76 defined along the width of the locking element 58, such that the stop latch can extend between the abutment feature 74 inside the housing 55 and the frame facing portion 57. The width of the channel 76 is slightly larger than the width of the stop latch 70 in such a way that the latter can pivot inside the channel 76. It is appreciated that the maximum pivoting angle of the stop latch 70 can be thus determined by the width of the channel 76.

This way, pivoting of the stop latch 70 to the released position thereof can be carried out by sidewardly pushing the head tip 78, disengaging thereby the tail portion 72 from the abutment feature 74 inside the housing 55.

The latch arrangement 51 further includes an actuating mechanism 80 configured to displace the locking element 58 to the unlocked position. According to the illustrated example the actuating mechanism 80 is further configured to pivot the stop latch 70 to the released position thereof such that the locking element 58 is unsecured and can be pivoted to the unlocked position.

The actuating mechanism 80 includes an actuating member 82 slidably mounted on the panel, for example inside a groove 85 defined in close proximity to the frame facing portion 57 and extending transversely with respect to the panel 50. The actuating member 82 includes a first end 84*a* facing an outer surface of the panel 50 and a second end 84*b* facing the head tip 78.

The actuating mechanism 80 further includes a manually operable handle 88 pivotally mounted on the panel 50, such that when a first end thereof is pivoted away from the panel 50, a second end 90 thereof is pushed towards the panel, as shown in FIG. 2D. The second end 90 of the handle 88 is configured to engage the first end 84*a* of the actuating member 82.

This way, when the handle 88 is pivoted away from the panel 50 the actuating member 82 is pushed by the second end 90 of the handle 88 and is urged to slide and to push thereby the head tip 78 of the stop latch 70. As a result, the stop latch 70 pivots to the released position thereof such that the tail portion 72 disengages the abutment feature 74 inside the housing 55, and the locking element 58 is free to pivot away from the depression 60.

As explained hereinabove, the channel 76 in which the stop latch 70 is mounted is so configured to allow a predetermined pivoting angle, such that when the stop latch 70 is pivoted to the maximum pivoting angle, the tail portion 72 of the stop latch 70 abuts the inner wall of the channel 76. Accordingly, further displacement of the actuating member 82 causes the second end 84*b* thereof to further push the head tip 78 of the stop latch 70 which can no longer pivot, thus causing displacement of the locking element 58 in which the stop latch 70 is mounted away from the depression 60.

This way, a single pivoting motion of the handle 88 such that the first end thereof is pulled away from the panel 50, shifts the stop latch 70 to the released position thereof, immediately following by pivoting of the locking element 58 to the unlocked position.

As shown in FIG. 2E, according to the illustrated example, the handle 88 is so mounted on the panel 50, such that pivoting thereof towards an opening direction of the panel causes the actuating member 82 to displace the stop latch 70 to the released position thereof, and the locking element 58 to the unlocked position thereof. This way, when it is desired to unlock and open the door panel 50 a single motion in one direction is required.

It is appreciated that the locking element 58 can include a return mechanism (not shown) configured to urge the locking element 58 away from the housing 55 to the locked position. Similarly, the stop latch 70 can be biased to normally be disposed in the secure position thereof.

FIGS. 3A through 4B show a door or a window having latch arrangement 101 according to another example, configured for fastening a panel 100 to the frame element 102. As in the previous example, the panel is a panel of a hinged door and is configured to abut, in the closed state thereof, against a shoulder portion 104 defined on the frame element 102, which includes a housing 105 for holding therein the latch arrangement 101. In addition the panel includes a handle 132, pivotally mounted in close proximity to the end thereof, and is configured to allow opening of the panel 100 as explained hereinafter in detail.

Figure 3C:
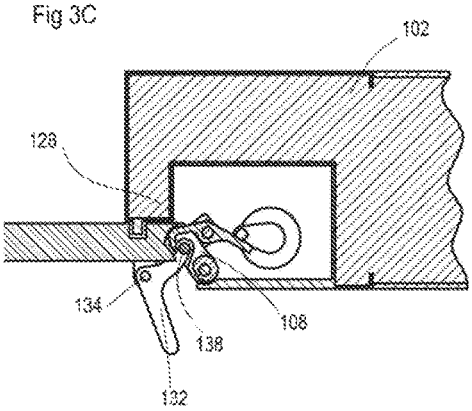
FIG. 3C is a view similar to FIG. 3B showing the panel in a locked position of the latch arrangement.
Figure 3D:
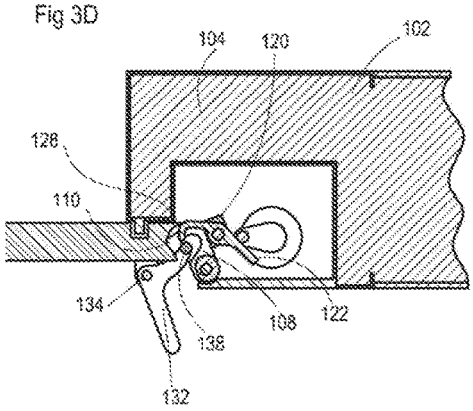
FIG. 3D is a view similar to FIG. 3B showing the panel in an unlocked position of the latch arrangement.
Figure 3E:
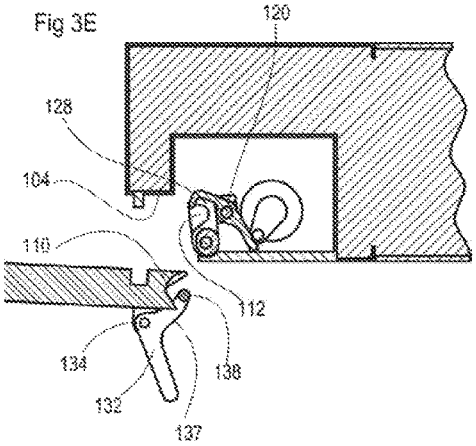
FIG. 3E is a view similar to FIG. 3B showing the panel in an opened state thereof and in which the latch arrangement is in an unlocked position.

As in the previous example, the latch arrangement 101 includes a locking element 108 pivotally mounted on the frame element 102 and is displaceable between a locked position, as shown in FIG. 3B, and an unlocked position shown in FIGS. 3D, and 3E. In addition, as in the previous example, the latch arrangement 101 includes a stop latch 120 selectively deployable to secure the locking element 108 in the locked position.

According to the present example however, actuating the locking element 108 and the stop latch 120 can be carried out either by a manual actuator 137 pivotally mounted on the door panel 100, or by a rotating actuator 117 mounted inside the housing 105. In addition, it should be noted that according to the present example, the stop latch 120 is configured to secure the locking element 108 by engaging a catch member on the manual actuator 137, which is mounted to the panel 100. This is as opposed to the previous example, in which the stop latch 70 is configured to secure the locking element 58 by engaging an abutment feature mounted on the frame element 12.

It will be appreciated that the rotating actuator 117 can be replaced with a liner actuator configured to pivot the stop latch 120 and the locking element 108.

A detailed explanation of the present example is followed with reference to FIGS. 3B to 3E. The locking element 108 includes a first end 114 configured to engage a depression 110 defined on the frame facing portion 107 of the door panel 100, and a second end 116 affixed to the frame element 102. As shown in FIG. 3B, in the locked position, the locking element 108 is pivoted towards the panel 100 and is disposed at an oblique angle with respect to the panel 100. This way, in the locked position the first end 114 of the locking element 108 is engaged with the cutaway depression 110, locking thereby the panel 100 to the frame element 102, and in the unlocked position the locking element 108 is pivoted away from the cutaway depression 110, such that the panel 100 is unlocked and can freely rotate to the opened state thereof, as shown in FIG. 3E.

The stop latch 120 according to the present example is pivotally mounted on the locking element 108 and includes a tail portion 122 extending into the housing 105 and configured to engage the rotating actuator 117 mounted inside the housing 105. In addition the locking element 108 includes a hook 128 defined on an end of the stop latch 120 opposing the tail portion 122 and extending towards the frame facing portion 107.

The hook 128 is configured to engage a catch member 138 defined on the manual actuator 137 of the panel 100, such that the locking element 108 is secured in the locked position thereof.

Thus, the stop latch 120 is configured to pivot between a secured position, in which the locking element 108 is secured in the locked position thereof by the engagement of the hook 128 with the catch member 138, and a released position in which the locking element 108 is free to pivot towards the housing 105 disengaging thereby the cutaway depression 110 of the panel 100.

As mentioned above, the latch arrangement 101 according to the present example includes rotating actuator 117 mounted inside the housing 105. The rotating actuator 117 is configured to selectively rotate in a first and a second direction in a motion parallel to the pivoting motion of the stop latch 120, while engaging the tail portion 122 of the stop latch 120.

As shown in FIGS. 3C and 3D, when the rotating actuator 117 is rotated in a first direction, the rotational motion thereof urges the tail portion 122 of the stop latch 120 to pivot until the hook 128 on the other end of the stop latch 120 disengages the catch member 138 on the manual actuator 137, and the stop latch 120 is displaced to the released position.

The pivoting angle of the stop latch 120 can be limited by engagement with the locking element 108, such that further rotation of the rotating actuator 117 in the first direction urges the locking element 108 to pivot away from the depression 110 to the unlocked position thereof, as shown in FIG. 3D.

With reference to FIG. 3E, as the locking element 108 is pivoted away from the depression 110 and completely disengaged therefrom, the door panel 100 can be pulled by the handle 132 to the opened state thereof.

The rotating actuator 117 can be rotated in a second direction, such that the tail portion 122 of the stop latch 120 can be pivoted back to the secured position and the locking element 108 is pivoted back to the locked position. It is appreciated that the pivoting of the stop latch 120 and the locking element 108 back to the secured and locked position, respectively, can be carried out by a return mechanism, such as a spring (not shown), etc. Accordingly, the rotating actuator 117 is configured to oppose the force of such return mechanism when the rotating actuator 117 is rotated in the first direction. When the rotating actuator 117 is rotated in the first direction however, the stop latch 120 and the locking element 108 are urged back to the secured and locked position, respectively, by the forces of the return mechanism.

As indicted above, according to the present example actuating the locking element 108 and the stop latch 120 can be carried out by means of a manual actuator 137 pivotally mounted on the door panel 100. The manual actuator 137 can be integrally formed with a handle 132 including a grip 135 and the manual actuator 137. The handle 132 can be configured to pivot on the panel 100 about a pivoting point 134 defined between the grip 135 and a manual actuator 137. According to the present example, the manual actuator 137 is configured to engage a recess 112 defined on the locking element 108 in the locked position, as shown in FIG. 3B.

As noted above, according to the present example, the actuating mechanism for displacing the locking element between the locked and unlocked position includes a manual actuator 137 and a rotating actuator 117. It is appreciated that the manual actuator 137 and the rotating actuator 117 can operate independently from one another.

Figure 4A:
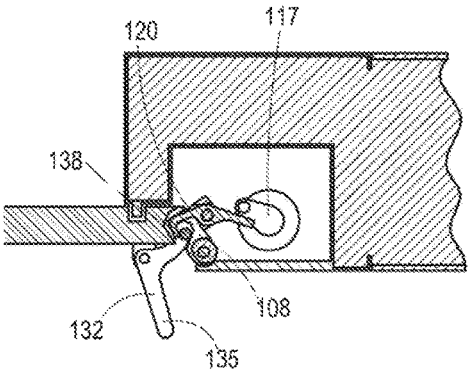
FIG. 4A is a view similar to FIG. 3B showing the panel in another locked position of the latch arrangement.
Figure 4B:
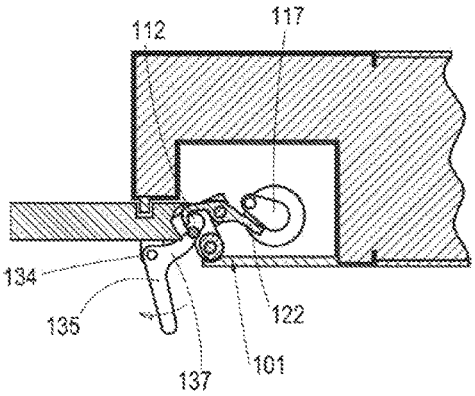
FIG. 4B is a view similar to FIG. 3B showing the panel in a another unlocked position of the latch arrangement.

Attention is now directed to FIGS. 4A and 4B, in which the operation of the manual actuator 137 is illustrated. For manual opening of the door panel 100, the handle 132 can be pivoted towards an opening direction of the panel 100, causing thereby the manual actuator 137 to slide out of the recess 112 disengaging thereby the catch member 138 from the hook 128, such that the locking element 108 is no longer secured by the stop latch 120 and the catch member 138. As shown in FIG. 4B, further pivoting of the handle 132 towards an opening direction of the panel 100, causes the manual actuator 137 to push the locking element 108 away from the depression 110 to the unlocked position.

Attention is now directed to FIGS. 5A to 5E, a latch arrangement 151 can be implemented for fastening a panel 150 of a panic door to a frame element 152. As in the previous example, the panel 150 is a panel of a hinged door and is configured to abut, in the closed state thereof, against a shoulder portion 154 defined on the frame element 152 which includes a housing 155 for holding therein the latch arrangement 151. In addition the panel 150 includes a handle 162, pivotally mounted on the panel 150, and including a panic bar 164 horizontally extending along the panel 150. The panic door can be configured for an outdoor opening direction, such that pushing of the panic bar 164 in an opening direction of the door initiates the opening of the panel 150, as explained hereinafter.

Figure 5A:
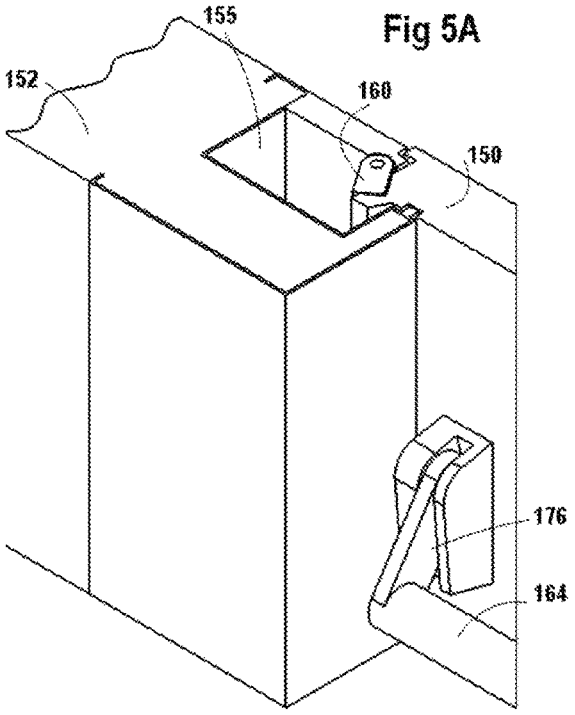
FIG. 5A is a perspective view of a panel having latch arrangement in accordance with another example of the presently disclosed subject matter cut-away along line X-X of FIG. 5F.
Figure 5B:
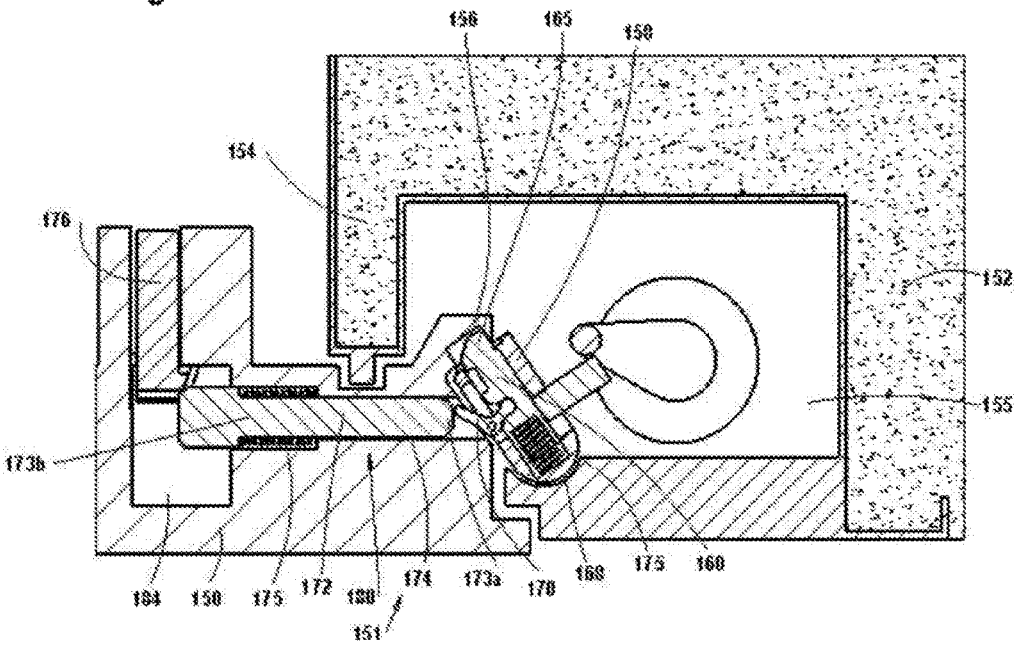
FIG. 5B is a partial cross-sectional view taken along the line X-X of FIG. 5F showing the panel of FIG. 5A.
Figure 5A:
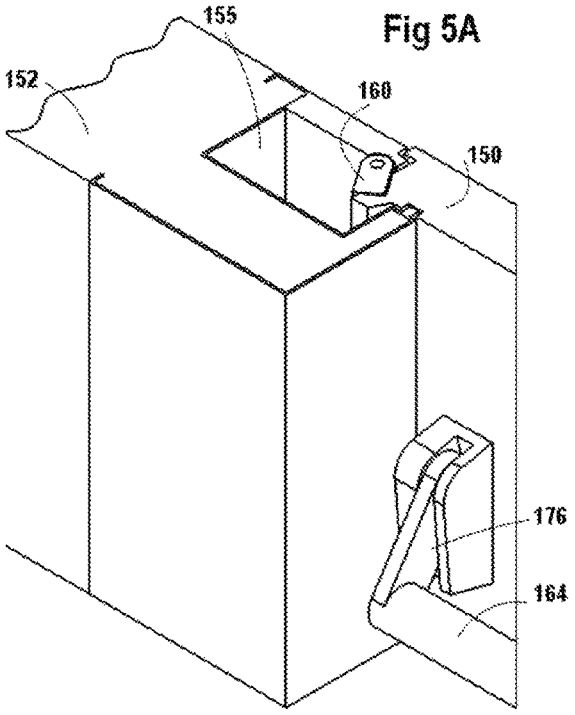
Figure 5B:
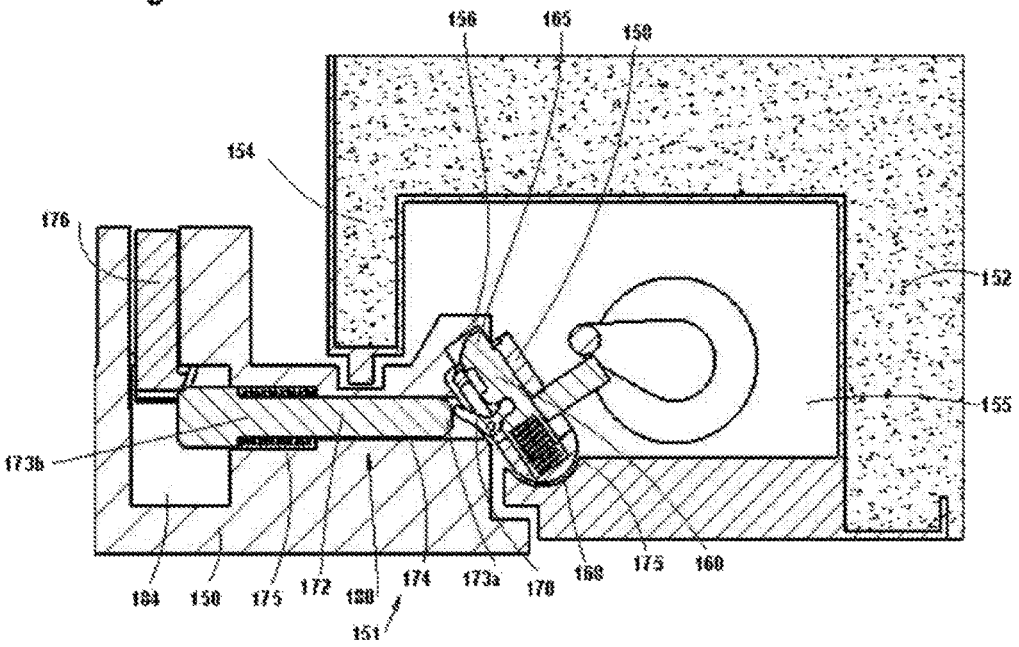
Figure 5C:
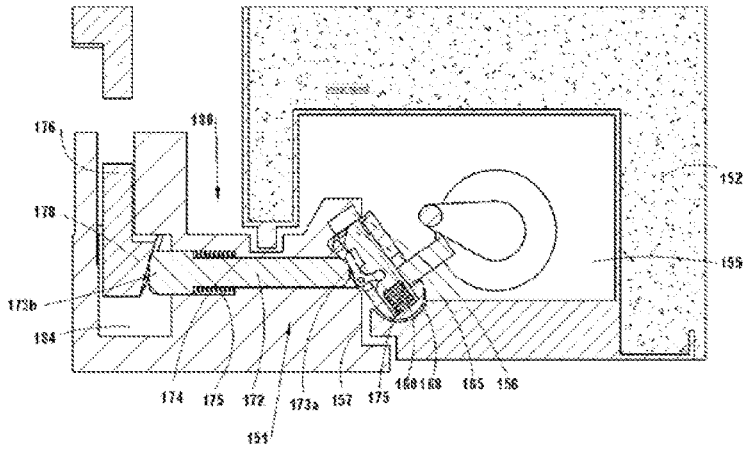
FIG. 5C is a view similar to FIG. 5B showing the panel in a locked position of the latch arrangement.
Figure 5D:
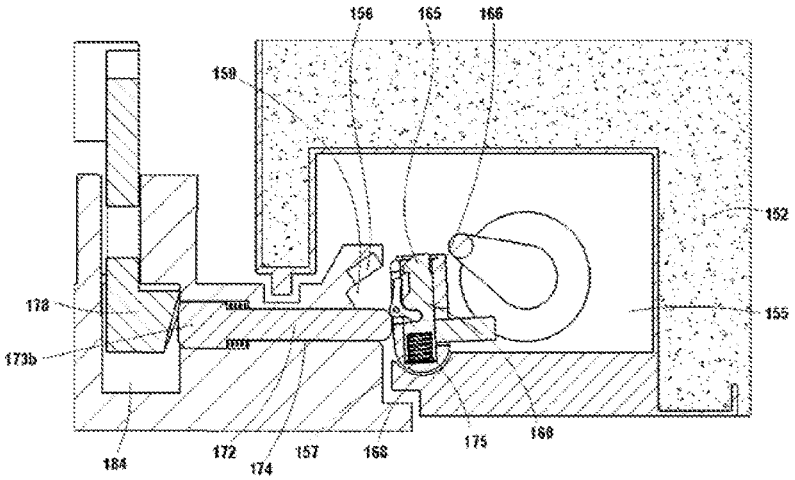
FIG. 5D is a view similar to FIG. 5B showing the panel in an unlocked position of the latch arrangement.

As in the previous example, the latch arrangement 151 includes a locking element 158 pivotally mounted on the frame element 152 and displaceable between a locked position, as shown in FIG. 5B, and an unlocked position shown in FIGS. 5D, and 3E. In addition, as in the previous example, the latch arrangement 151 includes a stop latch 160 selectively deployable to secure the locking element 158 in the locked position.

According to the present example however, the stop latch 160 is slidably mounted inside the locking element 158 and is configured to slide between a secured position in which at least one of the stop latch 160 is engaged with an abutment feature in a form of a recess 156, and a released position in which at least one portion of the stop latch 160 is retracted away from the recess 156. Further, according to the present example the abutment feature i.e. the recess 156 is defined on the panel 150, as explained hereinafter, this is as opposed to the example of FIGS. 2A to 2E in which the abutment feature 74 is mounted on the frame element.

Figure 5E:
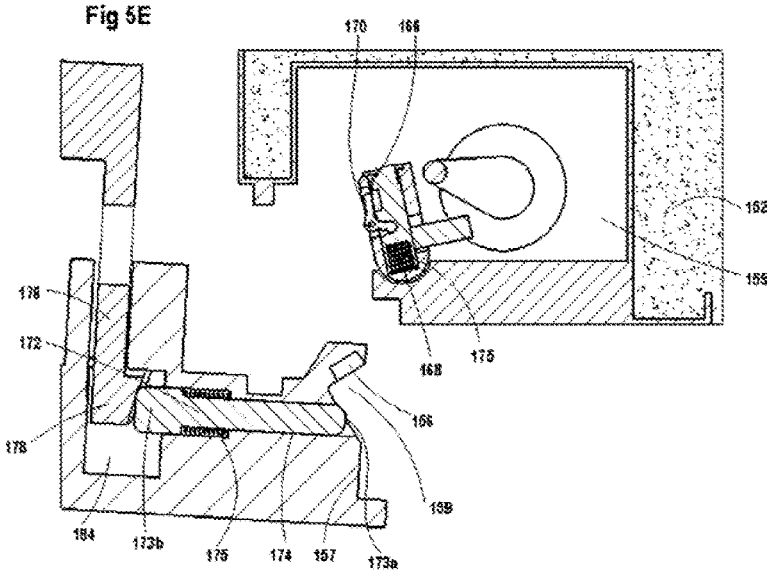
FIG. 5E is a view similar to FIG. 5B showing the panel in an opened state thereof and in which the latch arrangement is in an unlocked position.

A detailed explanation of the present example is followed with reference to FIGS. 5B to 5E. The locking element 158 includes a first end 166 configured to engage a depression 159 defined on the frame facing portion 157 of the door panel 150, and a second end 168 affixed to the frame element 152. As shown in FIG. 5B, in the locked position, the locking element 158 is pivoted towards the panel 150 and is disposed at an oblique angle with respect to the panel 150. This way, in the locked position the first end 166 of the locking element 158 is engaged with the cutaway depression 159, locking thereby the panel 150 to the frame element 152, and in the unlocked position the locking element 158 is pivoted away from the cutaway depression 159, such that the panel 150 is unlocked and can freely rotate to the opened state thereof, as shown in FIG. 5E.

As indicated above, the stop latch 160 according to the present example is slidably mounted inside the locking element 158 and is configured to selectively slide between a secured position in which at least an engaging portion 165 thereof protrudes from the first end 166 of the locking element 158, and a released position in which the stop latch 160 is retracted inside the locking element 158.

The stop latch 160 can be spring biased by a spring member 175 mounted inside the locking element 158, and is configured to urge the stop latch 160 to the secured position, i.e. the engaging portion 165 protrudes from the first end 166.

Further, as indicated above, the recess 156 according to the present example is configured as a recess formed inside the cutaway depression 159, and configured to engage with the engaging portion 165 of the stop latch 160.

Thus, when the door panel 150 is at the closed state thereof, and the locking element 158 can be pivoted to the locked position in which the first end 166 thereof is engaged with the cutaway depression 159 on the door panel 150. At this position, the stop latch 160 can be shifted to the secured position thereof, in which the engaging portion 165 protrudes from the first end 166, such that it engages the recess 156 formed inside the cutaway depression 159 precluding thereby the pivoting of the locking element 158 away from the depression 159 to the unlocked position.

The locking element 158 further includes a pivot arm 170 pivotally mounted thereon and being coupled to the stop latch 160, such that when the pivot arm 170 is pivoted towards the locking element 158, the stop latch 160 is urged to slide towards the inside the locking element 158 to the released position, the purpose of the pivot arm 170 is explained herein below.

The latch arrangement 151 further includes an actuating mechanism 180, having an actuating member, here illustrated as an actuating pin 172 slidably disposed inside a groove 174 defined the panel 150 and having a first end terminating at the frame facing portion 157 of the door panel 150, and a second end terminating at a hollow portion 184 defined inside the panel 150. The groove 174 according to the illustrated example is so defined such that, when the panel 150 is in the closed state thereof, the groove 174 coaxially disposed with the pivot arm 170 of locking element 158.

The actuating pin 172 is thus configured to slide inside the groove 174 between the first and second ends of the groove 174, towards and away from the outer surface of the frame facing portion 157, such that the first end 173*a* thereof can selectively engage the pivot arm 170. As shown in FIG. 5B, the actuating pin 172 is disposed such that the second end 173*b* thereof is disposed inside the hollow portion 184, the purpose of which is explained hereinafter.

This way, as shown in FIG. 5C, when the actuating pin 172 is slid forwards and is engaged with the pivot arm 170 the latter pivots and causes the stop latch 160 to slide towards the inside the locking element 158 to the released position thereof, as shown in FIG. 5D.

The actuating pin 172 can be biased by a spring 175, such that is normally urged away from the outer surface of the frame facing portion 157. At this position, the pivot arm 170 is pivoted towards the first end of the groove 174.

According to an example, the actuating mechanism 180 can be manually operated by the handle 162 which, as noted above, includes a panic bar 164 pivotally mounted on the panel 150. The handle 162 can be displaceable between a first position in which the locking element 158 is urged away from the depression 159 and a second position in which the locking element 158 is free to engage the depression 159.

For example, the handle 162 can include a pivoting mount 176, on which the panic bar 164 is mounted. The pivoting mount 176 is pivotally mounted on the door panel 150 and includes a sloped member 178 configured to pivot in and out of a hollow portion 184 formed inside the panel 150. The hollow portion 184 is defined such that the second end of the groove 174 is accessible through the hollow portion 184, and the second end 173*b* of the actuating pin 172 protrudes inside the hollow portion 184.

The sloped member 178 of the pivoting mount 176 includes a portion having varying thickness so defined thereon such that when the sloped member 178 is pivoted inside the hollow portion 184 the sloped portion faces the second end of the groove 174 and engages the second end 173*b* of the actuating pin 172, which as indicated above is disposed in the hollow portion 184.

This way, when the panic bar 164 is pushed to the first position thereof, the pivoting mount 176 is pivoted and the sloped member 178 slides inside the hollow portion 184 such that the sloped member 178 engages the end of the actuating pin 172.

As a result, the sloped member 178 selectively urges the actuating pin 172 to slide inside the groove 174 towards the frame facing portion 157 pushing thereby the pivot arm 170 to pivot and displace the stop latch 160 to the release position. Further pushing of the panic bar 164 causes the sloped member 178 to further pivot into the hollow portion 184 and the actuating pin 172 to further slide inside the groove 174. At this position the further displacement of the pivot arm 170 in limited by the locking element 158, thus further displacement of the pivot arm 170 by the actuating pin 172 causes the locking element 158 to pivot away from the cutaway depression 159.

When the panic bar 164 is released to the second position of the handle, the spring 175 of the actuating pin 172 biases the actuating pin 172 such that it is retracted back toward the hollow portion 184, and the allowing the pivot arm 170 to pivot back and displace the stop latch 160 to the secured position in which the engaging portion 165 of the stop latch 160 engages the recess 156 formed inside the cutaway depression 159 precluding thereby the pivoting of the locking element 158 away from the depression 159 to the unlocked position.

FIGS. 6A to 6E show a latch arrangement 201 configured for fastening a panel 200 of a sliding door to a frame element 202, this is as opposed to the previous example, in which the panel is a panel of a hinged door. Similar to the previous examples the latch arrangement 201 includes a locking element 210 pivotally mounted on the frame element 202 and an actuating mechanism including a manually operable handle 212 mounted on the panel 200 and being configured to interact with the locking element 210 to lock the panel to the frame element 202.

The frame element 202 includes a first side portion 204*a* coupled to a second side portion 204*b* and being spaced apart from the first side portion 204*a* defining thereby a housing 206 therebetween. The housing 206 is configured for receiving therein an end segment of the panel 200.

The frame element 202 further includes an abutting portion 208 transversely extending inside the housing 206 from the first side portion 204*a* defining an opening 205 between an edge thereof and the second side portion 204*b*. The opening 205 is configured to allow sliding of the end segment of the panel 200 therethrough into the housing 206.

According to this example, the panel 200 can include a depression having shoulder portion 209 protruding from the surface of the panel 200 towards the first side portion 204*a* of the frame element 202.

Figure 6A:
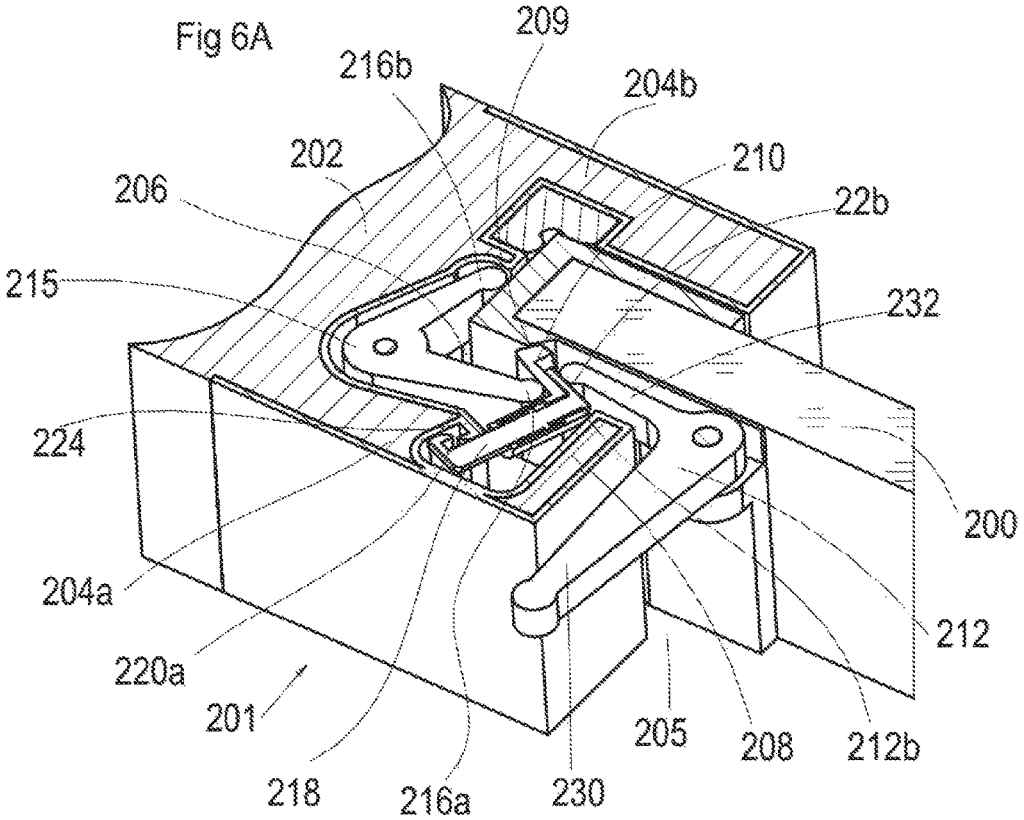
FIG. 6A is a perspective view of a panel having latch arrangement in accordance with yet another example of the presently disclosed subject matter cut-away along line X-X of FIG. 6F.
Figure 6F:
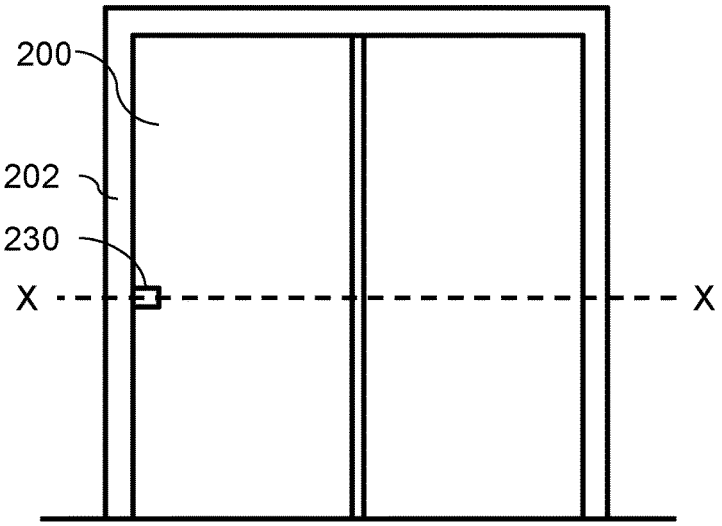
FIG. 6F is a front view of the panel of FIGS. 6A-6E within a frame.
Figure 6B:
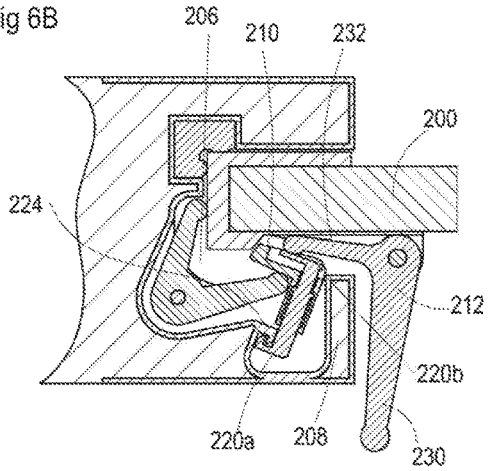
FIG. 6B is a partial cross-sectional view taken along the line X-X of FIG. 6F showing the panel of FIG. 6A.
Figure 6C:
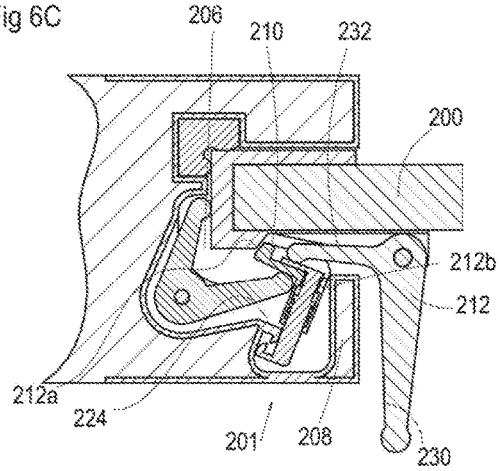
FIG. 6C is a view similar to FIG. 6B showing the panel in a locked position of the latch arrangement.
Figure 6D:
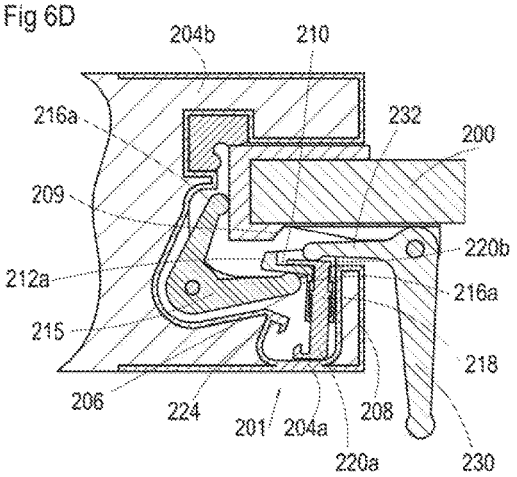
FIG. 6E is a view similar to FIG. 6B showing the panel in an opened state thereof and in which the latch arrangement is in an unlocked position.
Figure 6E:
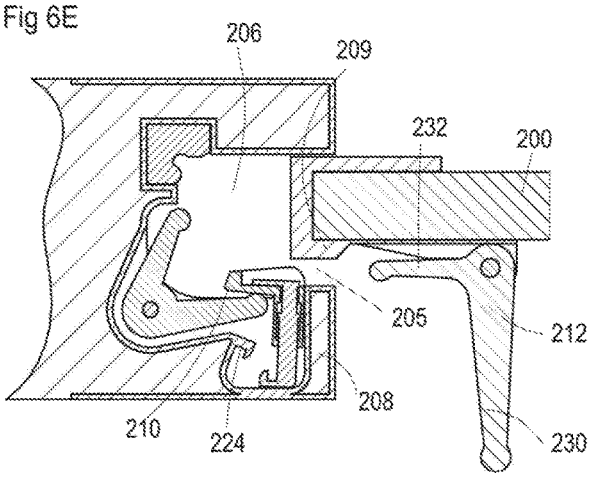

The locking element 210 include a first end 212*a* and a second end 212*b*, and is disposed in the housing 206 and displaceable between a locked position (FIGS. 6A and 6B) and an unlocked position (FIGS. 6D and 6E). In the locked position the first end 212*a* of the locking element 210 is engaged with shoulder portion 209 of the panel 200, while the second end 212*b* is engaged with the abutting portion 208 of the frame element 202 precluding thereby the sliding of the panel 200 out of the housing 206. In the unlocked position the locking element 210 is pivoted such that the first end 212*a* of the locking element 210 is disengaged from the shoulder portion 209 of the panel 200 such the panel 200 is free to be slid away from the frame element 202 to the open state thereof.

According to an example, the locking element 210 in the locked position is extended at an oblique angle with respect to the panel 200 such that the first end 212*a* is engaged with the shoulder portion 209 which can also be formed with a corresponding angle. This way, in the locked position of the locking element 210 the displacement of the panel 200 towards an opening direction of the panel is opposed by compressive forces exerted between the locking element 208 and the butting portion 208 of the frame element 202.

The latch arrangement 201 can further include a positive lock member 215 pivotally mounted inside the housing 208 and having a first arm 216*a* and a second arm 216*b*. The first arm 216*a* is configured to engage an edge of the panel 200 when in the closed state, and the second arm 216*b* is configured to engage a surface of the locking element 210. The positive lock member 215 is configured such the when the panel 200 is slid into the housing 208 to the closed state thereof, the edge of the panel 200 engages the first arm 216*a* and pushes it in a direction parallel to the closing direction of the panel 200. As a result, the positive lock member 215 is pivoted and the second arm 216*b* urges the locking element 210 to the locked position, i.e. the first end 212*a* is engaged with the shoulder portion 209. Thus, the positive lock member 215 allows an autonomous displacement of the locking element 210 to the locked position thereof upon closing of the door panel 200.

It is appreciated that the positive lock member 215 is an optional element, and the latch arrangement 201 according to other examples include a return mechanism configured to urge the locking element 210 to the locked position thereof.

As in the previous example, the latch arrangement 201 further includes a stop latch 218 selectively deployable to secure the locking element 210 in the locked position. The stop latch 218 is slidably mounted inside the locking element 210 and include a hook portion 220*a* defined on one end thereof and an engaging portion 220*b* defined on an opposing end thereof. The stop latch 218 is configured to slide inside the locking element 210 while the hook portion 220*a* is disposed on one side of the locking element 210 while the engaging portion 220*b* is disposed on a second side of the locking element 210. The stop latch 218 is configured to slide between a secured position in which the hook portion 220*a* is engaged with an abutment feature in a form of a catch member 224 on the frame element 202, and a released position in which the hook portion 220*a* is disengaged from the catch member 224.

The hook portion 220*a* of the stop latch 218 and the catch member 224 on the frame element 202 are configured to be engaged to one another when the locking element 210 is pivoted to the locked position thereof. That is to say, catch member 224 on the frame element 202 is disposed in parallel with the sliding axis of the stop latch 218, when the locking element 210 is in the locked position. This way, at this position, as shown in FIGS. 6B and 6C, the stop latch 218 can be selectively slid between a secured position in which the hook portion 220*a* is engaged with the catch member 224 on the frame element 202, precluding thereby the pivoting of the locking element 210 to the unlocked position thereof, and a released position in which the hook portion 220*a* is disengaged from the catch member 224, and the locking element 210 is free to pivot to the unlocked position thereof.

Since the stop latch 218 is mounted on the locking element 210, when the latter is pivoted to the unlocked position thereof, the catch member 224 is no longer parallel to the sliding axis of the stop latch 218 and the hook portion 220*a* can no longer be engaged with the catch member 224, as shown in FIG. 6D. At this position, the panel 200 can be slid out of the housing 206 as shown in FIG. 6F.

The stop latch 218 can be biased by a spring member 222 mounted inside the locking element 210 urging the stop latch 218 to the secured position thereof.

The latch arrangement 201 further includes an actuating mechanism including a manually operable handle 212 mounted on the panel 200 and being configured to interact with the locking element 210 to lock the panel to the frame element 202.

According to the illustrated example, the handle 212 is pivotally mounted on the panel 200 and includes a grip 230 and an actuating member 232. The actuating member 232 is disposed in close proximity with the surface of the panel 200, while the grip 230 protrudes away from the surface of the panel 200 such that it can be griped.

The handle 212 is mounted such that when the edge of the panel 200 is inserted inside the housing 206, the actuating member 232 is inserted therewith and is configured to engage the engaging portion 220*b* of the stop latch 218.

The handle 212 can be pivoted between a first position in which the actuating member 232 is pivoted towards the surface of the panel 200 and a second position in which the actuating member 232 is pivoted away the surface of the panel 200. As shown in FIG. 6C, when the panel is in the closed state thereof pivoting the handle 212 to the second position causes the actuating member 232 to engage the engaging portion 220*b* of the stop latch 218, and to urge the stop latch 218 to slide to the released position thereof. At this position the hook portion 220*a* is disengaged from the catch member 224, and the locking element 210 is free to pivot to the unlocked position thereof.

As can be seen in FIG. 6C, the sliding of the stop latch 218 inside the locking element 210 is limited by the engaging portion 220*b* abutting against the locking element 210. Thus further pivoting of the handle 212 causes the engaging portion 220*b* to urge the locking element 210 to pivot to the unlocked position thereof, as shown in FIG. 6D.

This way, a single motion of pivoting the handle 212 such that the actuating member 232 thereof is pulled away from the panel 200, shifts the stop latch 218 to the released position thereof, immediately following by pivoting of the locking element 210 to the unlocked position.

As shown in FIG. 6E, according to the illustrated example, the handle 212 is so mounted on the panel 200, such that pivoting of the grip 230 towards an opening direction of the panel 200 causes the actuating member 232 to displace the stop latch 218 to the released position thereof, and the locking element 210 to the unlocked position thereof. This way, when it is desired to unlock and open the door panel 200 a single motion of pulling the grip 230 in one direction is required.

Those skilled in the art to which the presently disclosed subject matter pertains will readily appreciate that numerous changes, variations, and modifications can be made without departing from the scope of the invention, mutatis mutandis.

The invention claimed is:

1. A latch arrangement for fastening a door or window panel to a frame element, the latch arrangement comprising:

a locking element mounted on the frame element and displaceable between a locked position in which said locking element is engaged with a surface rigidly defined on the panel thereby locking the panel to the frame element, and an unlocked position in which said locking element is disengaged from the surface thereby unlocking the panel to allow opening of the panel without movement of the frame element;

an actuating mechanism mounted on the panel and configured to selectively engage said locking element and to displace said locking element out of engagement with the surface to said unlocked position, wherein said locking element is mounted on the frame element so as to undergo motion comprising a rotary motion between said locked position and said unlocked position, and wherein said actuating mechanism is configured to selectively move said locking element to said unlocked position.

2. The latch arrangement according to claim 1 wherein said actuating mechanism comprises a handle displaceably mounted on the panel so as to be displaceable between a first position in which said actuating mechanism urges said locking element out of engagement with the surface and a second position in which said actuating mechanism allows said locking element to engage the surface.

3. The latch arrangement according to claim 2 wherein in said first position said handle is pivoted towards an opening direction of the panel.

4. The latch arrangement according to claim 2 wherein said actuating mechanism includes an actuating member displaceably mounted on the panel and configured to selectively move towards said locking element whereby said locking element is displaced to said unlocked position.

5. The latch arrangement according to claim 4 wherein said handle includes a portion engaging said actuating member, and wherein said handle is configured such that, when said handle is displaced to said first position, said actuating member is displaced towards said locking element whereby said locking element is displaced to said unlocked position.

6. The latch arrangement according to claim 5 wherein said handle includes a panic bar configured to pivot towards the panel and a sloped member configured to pivot with said panic bar, said sloped member being configured to engages said actuating member, and wherein when said panic bar is pivoted towards the panel said sloped member is configured urge said actuating member to move towards said locking element.

7. The latch arrangement according to claim 4 wherein said actuating member is configured to move across at least part of a thickness dimension of the panel.

8. The latch arrangement according to claim 1 wherein said locking element in said locked position extends at an oblique angle with respect to the panel such that a first region of the locking element is deployed to engage the surface while a second region of the locking element is supported by the frame element, and wherein in said locked position displacement of the panel towards an opening direction of the panel is opposed by compressive forces exerted on said locking element.

9. A latch arrangement for fastening a door or window panel to a frame element, the latch arrangement comprising:

a locking element mounted on the frame element and displaceable between a locked position in which said locking element is engaged with a surface rigidly defined on the panel thereby locking the panel to the frame element, and an unlocked position in which said locking element is disengaged from the surface thereby unlocking the panel from the frame element;

a stop latch associated with said locking element and configured to be selectively displaced between a secured position in which said locking element is secured in said locked position, and a released position in which said locking element is free to displace to said unlocked position;

an actuating mechanism configured to selectively displace said stop latch to said released position and to displace said locking element to said unlocked position, wherein said actuating mechanism is mounted on the panel.

10. The latch arrangement according to claim 9 wherein said actuating mechanism comprises a manually displaceable handle displaceably mounted on the panel, and wherein the actuating mechanism is configured such that motion of said handle performs sequentially release of said stop latch following by a displacement of said locking element out of engagement with said surface.

11. The latch arrangement according to claim 10 wherein said stop latch is mounted on said locking element and is configured to selectively engage an abutment feature such that displacement of said locking element to the unlocked position is precluded.

12. The latch arrangement according to claim 11 wherein said stop latch is slidably mounted on said locking element and is configured to slide between a secured position in which at least one portion thereof is engaged with said abutment feature and a released position in which said at least one portion is retracted away from said abutment feature such that said locking element is free to be displaced to said unlocked position.

13. The latch arrangement according to claim 12 wherein said abutment feature is defined on the panel.

14. The latch arrangement according to claim 11 wherein said stop latch is pivotally mounted on said locking element and is configured to pivot between a secured position in which said locking element is secured in said locked position and a released position in which said locking element is free to be displaced to said unlocked position, and wherein said actuating mechanism is configured to selectively pivot said stop latch to said released position.

15. The latch arrangement according to claim 14 said abutment feature is defined on the frame element.

16. The latch arrangement according to claim 14 wherein said actuating mechanism includes a catch member and wherein in said secured position said stop latch is engaged with said catch member.

17. A panel closure comprising:

a frame element;

a panel configured to abut against a portion of said frame element; and the latch arrangement of claim 1, deployed to selectively fasten the panel to the frame element.

18. The panel closure of claim 17, wherein said panel is a sliding panel configured to slide towards and away from said frame element, between a closed state and an open state.

19. The panel closure of claim 17 wherein said panel is a hinged panel configured to rotate towards and away from said frame element, between a closed state and an open state.

20. A latch arrangement for fastening a door or window panel to a frame element, the latch arrangement comprising:

a locking element mounted on the frame element and displaceable between a locked position in which said locking element is engaged with a surface rigidly defined on the panel thereby locking the panel to the frame element, and an unlocked position in which said locking element is disengaged from the surface thereby unlocking the panel from the frame element;

an actuating mechanism mounted on the panel and configured to selectively engage said locking element and to displace said locking element to said unlocked position, wherein said locking element in said locked position extends at an oblique angle with respect to the panel such that a first region of the locking element is deployed to engage the surface and a second region of the locking element is supported by the frame element, and wherein in said locked position displacement of the panel towards an opening direction of the panel is opposed by compressive forces exerted on said locking element.

* * * * *